United States Patent [19]

Baley

[11] Patent Number: 4,494,949

[45] Date of Patent: Jan. 22, 1985

[54] SHEET FOLDING APPARATUS AND METHOD

[75] Inventor: William D. Baley, Dallas, Tex.

[73] Assignee: The Lehigh Press, Inc., Pennsauken, N.J.

[21] Appl. No.: 456,751

[22] Filed: Jan. 10, 1983

[51] Int. Cl.[3] ..... B65H 45/16

[52] U.S. Cl. ..... 493/432; 493/442; 493/450

[58] Field of Search ..... 493/418, 424, 432, 442, 493/450, 425, 426, 427, 428, 429, 430, 254, 433

[56] References Cited

U.S. PATENT DOCUMENTS

| | | | |
|---|---|---|---|
| 2,872,186 | 2/1959 | Raybuck | 493/418 |
| 4,073,485 | 2/1978 | Gregoire et al. | 493/432 |
| 4,113,243 | 9/1978 | Gregoire et al. | 493/432 |
| 4,345,906 | 8/1982 | Gregoire | 493/432 |
| 4,445,881 | 5/1984 | Bullen et al. | 493/432 |

FOREIGN PATENT DOCUMENTS

| | | | |
|---|---|---|---|
| 2318420 | 10/1974 | Fed. Rep. of Germany | 493/418 |

*Primary Examiner*—E. Michael Combs
*Assistant Examiner*—Charles Rosenberg
*Attorney, Agent, or Firm*—Robert K. Youtie

[57] ABSTRACT

The apparatus and method for folding a sheet or signature wherein the sheet or signature is passed edgewise along an arcuate path, a portion of the sheet or signature intermediate the leading and trailing edges thereof is gripped and withdrawn from the first arcuate path to a tangential second arcuate path, and a fluid or air stream is directed counter to and away from the second path to smoothly guide and gently fold the leading edge back upon the trailing edge.

17 Claims, 8 Drawing Figures

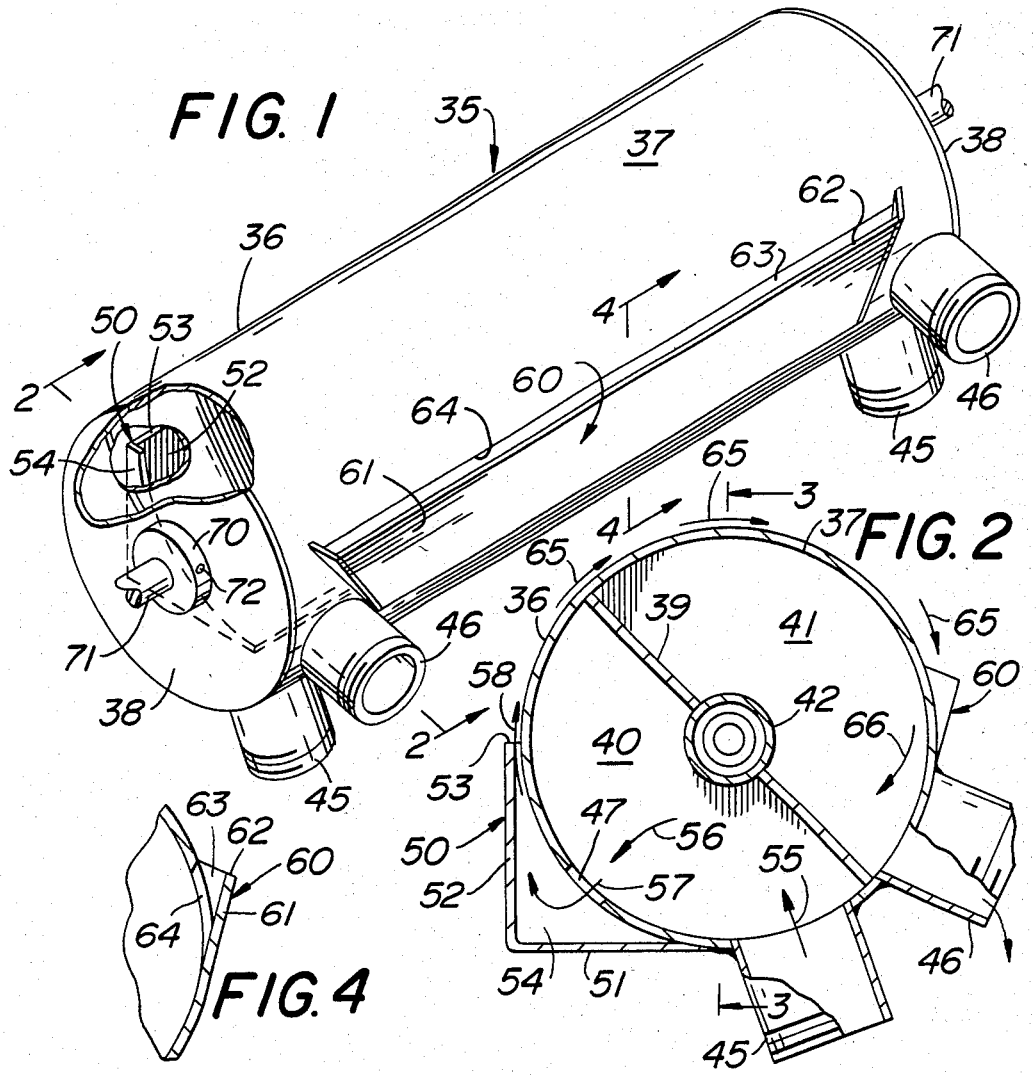
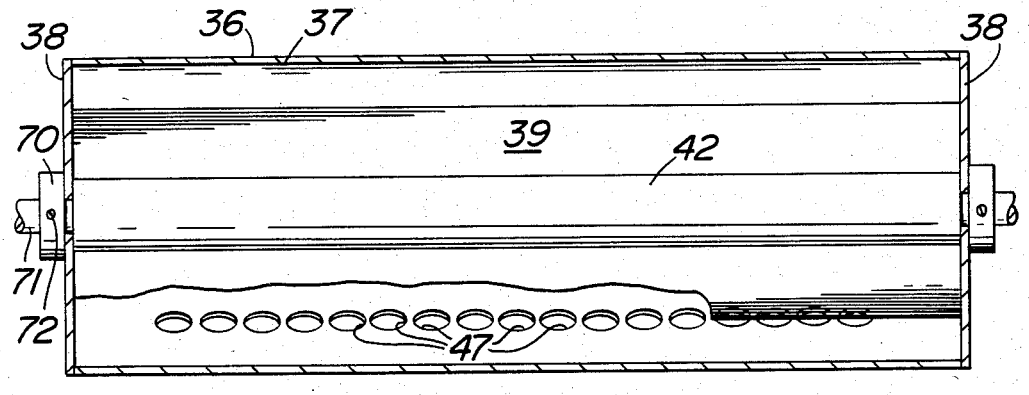
FIG. 3

FIG. 7
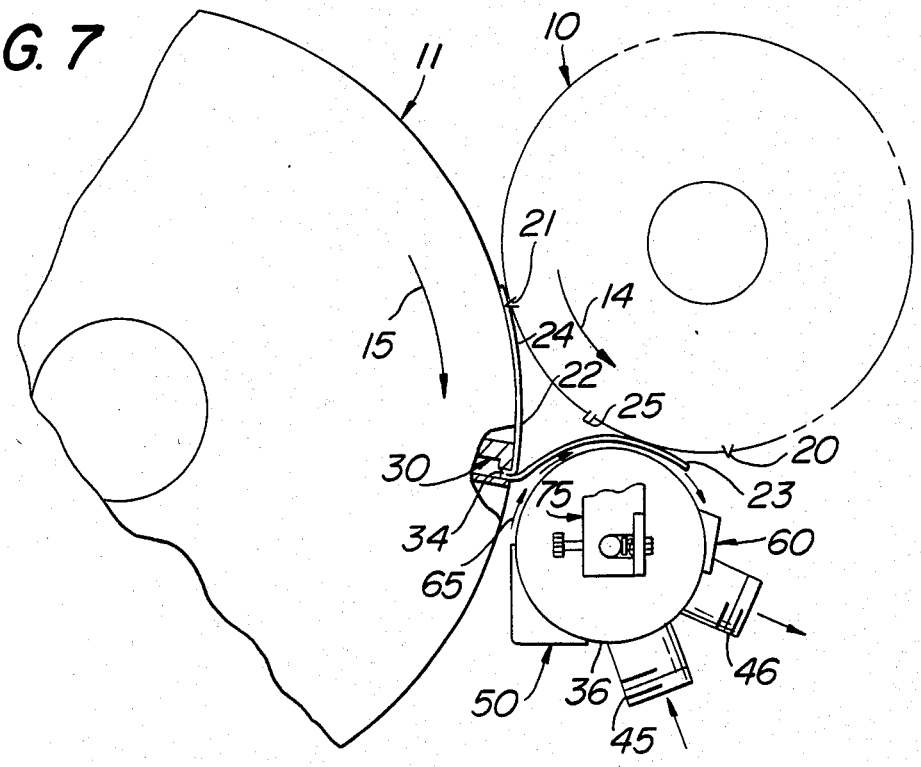
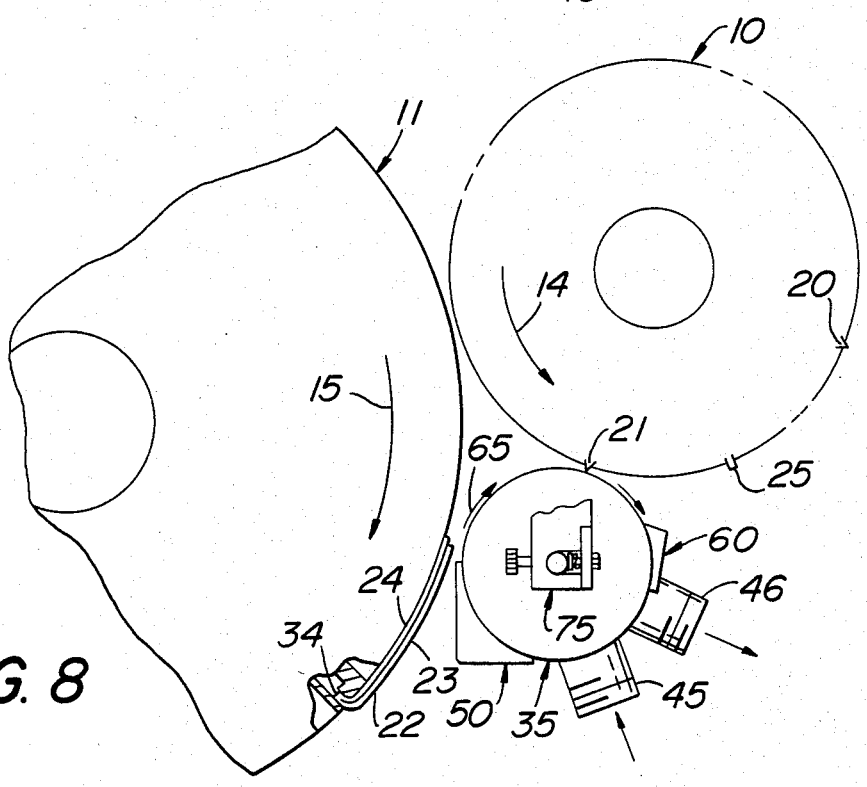
FIG. 8

SHEET FOLDING APPARATUS AND METHOD

BACKGROUND OF THE INVENTION

The method and apparatus of the present invention is particularly concerned with signature folding in web press printing applications. In such applications a tucker roll carries a sheet or signature edgewise into tangential relation with a jaw roll for gripping of an intermediate portion of the sheet and continued movement with the jaw roll, which effects folding of the sheet about a gripped region. In the folding action the initially leading edge portion is swung about the gripped region toward the trailing edge portion. As higher production speeds are attempted this folding operation results in wrinkling, tearing and like damage to the sheet material, especially to the leading edge portion upon its rearward swinging motion. In particular, the increased operating speeds tend to cause corrugating or wrinkling of the leading edge portions of the sheet, and the slapping of the leading edge sheet portion against the trailing edge sheet portion at high speed can cause creasing, cracking and tearing of the folded material.

While attempts have been made to overcome these high speed operating problems, the attempts have not been satisfactory. The prior art has proposed the use of bristle brushes to constrain the signature sheets to a desired path, and it has been proposed to use mechanical rollers and air pressured bars to overcome these problems, but without satisfactory results. Examples of the known prior art are shown in the following patents:

| U.S. Pat. Nos. | U.S. Pat. Nos. |
|---|---|
| 1,979,093 | 2,211,046 |
| 2,211,791 | 2,659,437 |
| 2,775,448 | 3,032,335 |
| 3,228,710 | 3,758,102 |
| 3,843,113 | 4,036,487 |
| 4,073,485 | 4,113,243 |

SUMMARY OF THE INVENTION

It is an important object of the present invention to provide a method and apparatus for use in signature folding apparatus, by which such apparatus may be run at higher speeds for greater productivity, while effectively insuring high quality to the folded sheet material with minimum down time.

It is a more particular object of the present invention to provide a method and apparatus for sheet folding wherein a fluid current is directed to guide the leading edge portion of a sheet during folding to smoothly and gently distend the sheet portion and fold the same at relatively high speed without damage to the sheet.

It is a further object of the present invention to provide an improvement in sheet folding apparatus which is extremely simple in structure, requiring no moving parts, and is capable of a long useful life at a relatively low cost and with a minimum of maintenance.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 1 is a perspective view showing a device of the present invention apart from the conventional signature folding apparatus, the device being partly broken away to illustrate the interior structure.

FIG. 2 is a transverse sectional view taken generally along the line 2—2 of FIG. 1.

FIG. 3 is a longitudinal sectional view taken generally along the line 3—3 of FIG. 2.

FIG. 4 is a partial sectional view taken generally along the line 4—4 of FIG. 1.

FIG. 7 is an elevational view similar to FIGS. 5 and 6 and showing still a later stage in the folding operation.

FIG. 8 is a side elevational view similar to FIGS. 5–7 and showing the method and apparatus illustrating a fully folded signature.

DESCRIPTION OF THE PREFERRED EMBODIMENT

Figure 5:
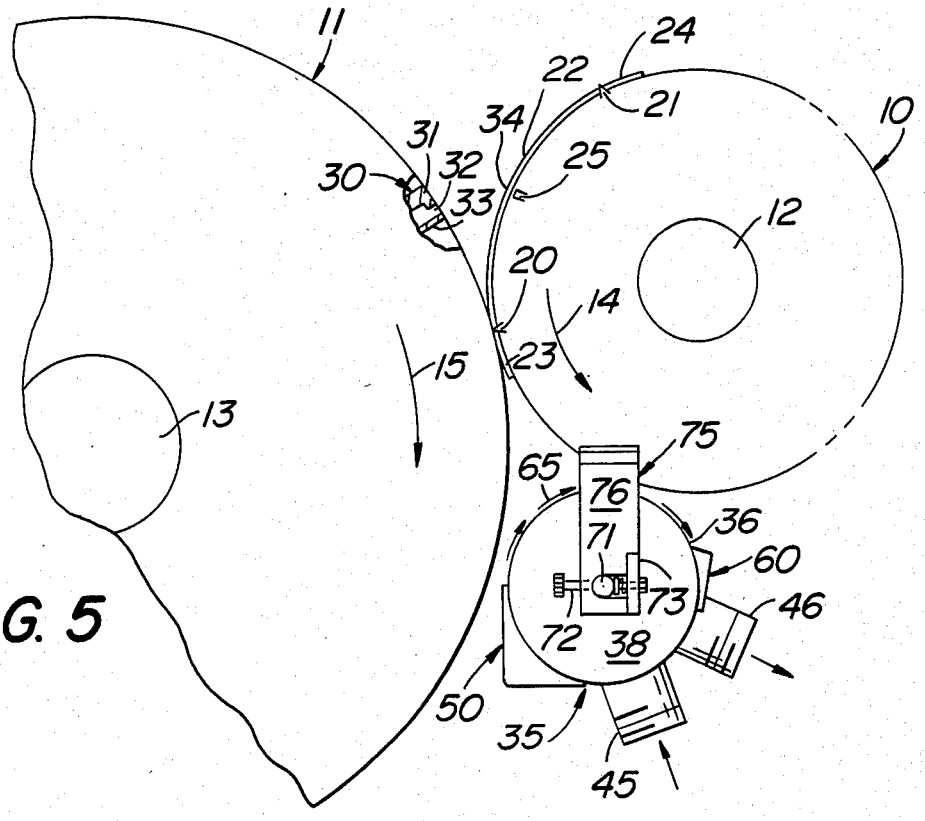
FIG. 5 is a side elevational view showing the device of FIGS. 1–4 in operative association with the tucker and jaw rolls of a signature folder and illustrating an early condition of the instant folding process.

In each of FIGS. 5–8 there is shown a generally horizontally disposed rotatable tucker cylinder or roll 10, and in generally tangential relation therewith a horizontally disposed rotatable jaw cylinder or roll 11. The tucker and jaw rolls 10 and 11 may be generally conventional, respectively rotating about the axes of horizontal shafts 12 and 13, in the respective directions of arrows 14 and 15.

The tucker cylinder or roll 10 may include leading and trailig sets of pins or holding fingers 20 and 21 for releasable holding engagement with the leading and trailing edge portions, respectively, of a signature or sheet 22. That is, the signature or sheet 22 lies along the periphery of the tucker roll 10, having its leading edge portion 23 and its trailing edge portion 24 respectively releasably secured to the tucker roll periphery by the pins or sheet holders 20. Medially between the sheet holders and pins 20 and 21, the tucker roll 10 is provided along its periphery with a radially extensile and retractile tucker member or presser bar 25 suitably operated, as by cam means or otherwise, to protrude beyond and retract within the periphery of tucker roll 10 in timed relation with rotation thereof.

The jaw roll 11 is provided along its periphery with jaw means 30 including a jaw member 31 having a gripping face 32 just inward of and facing along the periphery of the jaw roll. That is, the jaw face 32 lies in a plain generally radially of the jaw roll 11, and faces toward a complementary jaw part 33 in adjacent spaced relation with respect to the latter. The jaw 32 may be actuable, as by cam means or otherwise, upon rotation of the jaw roll 11 to move toward and away from the complementary member 33.

In operation, the tucker and jaw rolls 10 and 11 are timed to simultaneously locate their tucker member 25 and jaw means 30 at the tangential region of the rolls, whereupon the tucker member is caused to protrude and thereby bend the overlying, intermediate region 34 of the sheet 22 and engage said region into the jaw space between jaw parts 31 and 33. The jaw part 31 thereupon moves toward the jaw part 33 to grip the interposed intermediate sheet region 34 and retain the gripped region upon removal of the tucker member 25 by retraction thereof into the tucker roll 10.

As thus far described, the construction and operation may be conventional, it being understood that the gripping or jaw means 30 grips a portion of the sheet or signature 22 extending along a line intermediate the leading and trailing edge portions 23 and 24 of the sheet.

The gripped intermediate sheet portion 34 continues its movement along the path defined by the periphery of jaw roll 11 on the outlet side of or downstream from the nip or tangential region of the tucker and jaw rolls 10 and 11.

Figure 6:
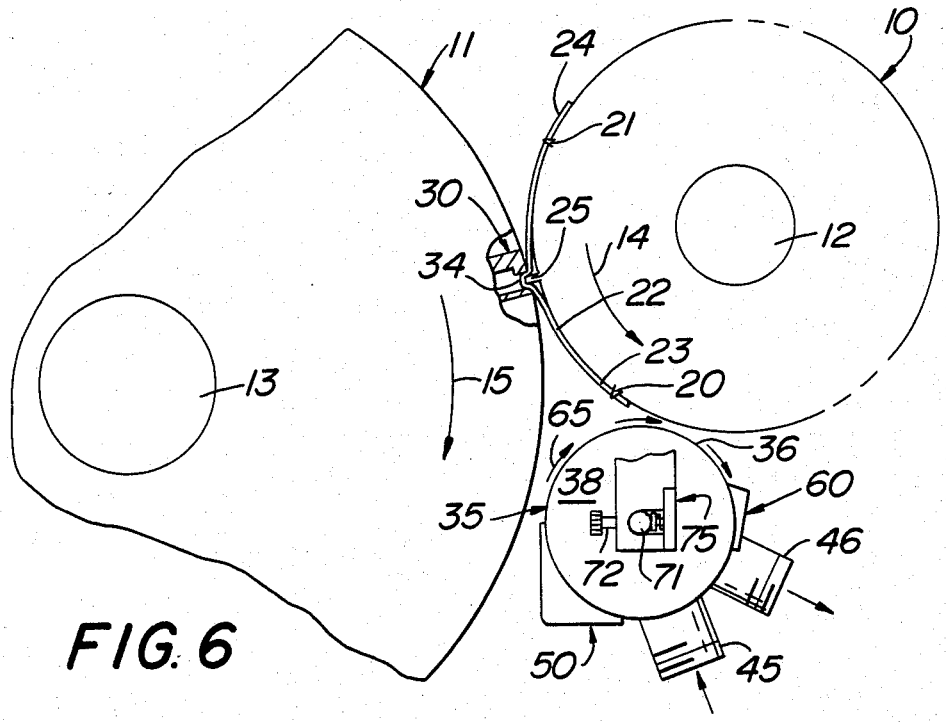
FIG. 6 is an elevational view similar to FIG. 5 showing a slightly later stage in the folding method.

Thus, the sheet or signature 22 is fed edgewise along a first path defined by the periphery of tucker roll 10 to the location shown in FIG. 6 with the intermediate sheet region 34 at the tangential region of the tucker and jaw rolls. From this position the sheet 22 continues movement along a second path defined by the periphery of the jaw roll, being moved therealong by the gripping action of the jaw means 30 with the bent or folded intermediate sheet portion 34 in the jaw means.

In this movement of the sheet 22 along the path of the periphery of jaw roll 11, the trailing edge portion 24 of the sheet may be smoothly guided or rolled between the tucker and jaw rolls 10 and 11 to lie against the periphery of the latter. (See FIG. 7) However, the leading edge portion 23, at about the stage of FIG. 6, is released from the leading edge portion holding means 20 to begin its rearward swinging movement toward the desired facing engagement with the rearward edge portion.

In order to accomplish this rearward swinging action of the leading edge portion 23 of the sheet 22, the instant invention provides at a location between the tucker and jaw rolls 10 and 11, on the outlet or downstream side of the nip or tangent roll region, an apparatus generally designated 35.

The apparatus 35 is best shown in FIGS. 1–4, and may there be seen to include a generally cylindrical hollow vessel or body 36 including a cylindrical side wall 37 and opposite end closures or walls 38. The cylindrical side wall 37 and end walls 38 combine to define the cylindrical vessel 36; and, a diametral internal wall or partition 39 secured in the vessel 36 and longitudinally coextensive therewith subdivides the interior of the vessel into a pair of semicylindrical chambers 40 and 41. As oriented in FIG. 2, the diametral internal wall or partition 39 extends obliquely from the lower right region of the side wall 37 to the upper left region thereof. Of course, the partition 39 also extends longitudinally to and is suitably secured to opposite ends 38. The wall or partition 39 may include, extending longitudinally therein, a tube 42 extending between and secured to opposite end walls 38. Opening into the lower or supply chamber 40 may be a pair of supply nipples or conduits 45. Similarly, a pair of outlet or return nipples or conduits 46 may open into the upper chamber 41. That is, the supply nipples 45 and return nipples 46 may be secured to the cylindrical side wall 37, in communication therethrough with the interior of vessel 36 on opposite sides of the partition 39.

A plurality of supply holes or openings 47 may be formed in a lower region of the cylindrical side wall 37 communicating between the interior and exterior of supply chamber 40. Exteriorly on the lower leftward region of the cylindrical side wall 37, as seen in FIG. 2, there is provided a supply nozzle 50 communicating through the openings 47 with the interior of supply chamber 40. The supply nozzle 50 may include a generally right angular formation including a lower wall or flange 51 secured to and extending generally laterally from a lower region of the cylindrical side wall 37, and a generally upright flange or wall 52 extending from the outer edge of wall 51 upwardly to a free upper edge 53 adjacent to and spaced from the leftmost portion of the cylindrical side wall 37, as seen in FIG. 2. The supply nozzle 50 may be substantially longitudinally coextensive with the vessel 36, and has its opposite ends closed by end walls 54.

Thus, air or other fluid entering the supply chamber 40 through nipples 45, as in the direction of arrow 55, may pass through the chamber 40, as at 56, exiting therefrom as at 57 into the supply nozzle 50, and exiting from the latter upwardly in the direction of arrow 58, generally tangent to the exterior of the cylindrical wall 37.

Generally diametrically opposed to the outlet of supply nozzle 50, exteriorly on the cylindrical side wall 37, is provided a fluid return or pickup nozzle 60. The nozzle 60 may include a wall portion 61 extending upwardly and outwardly from the rightward side of the cylindrical wall 37, generally tangent thereto, as seen in FIG. 5, and terminating in an upper edge 62 spaced from the cylindrical wall. The nozzle 60 may be generally longitudinally coextensive with the vessel 36, having opposite ends of the pickup nozzle closed, as by end walls 63. Within the pickup nozzle 60, inward of the wall 61, the cylindrical side wall 37 may be formed with an elongate slot 64, or is otherwise open to pass fluid inwardly in the direction of arrow 65, see FIG. 2, through the pickup 60 and into the chamber 41, in the direction of arrow 66. Fluid from the chamber 41 may exit through the return pipes 46, say to a cleaner and blower, or other pressurizing means, for return to the supply pipes 45.

In practice, air exits supply nozzle 50, as at 58, at a substantial velocity and passes exteriorly over the upper side of cylindrical side wall 37, as in the direction of arrows 65 for return through pickup nozzle 60 to chamber 41. This relatively high velocity fluid stream or current of air moves continuously over the smooth upper surface or working face of cylindrical side wall 37, a stream velocity in the approximate range of 260–330 feet per second has been found satisfactory. This relatively high velocity stream appears to reduce pressure in accordance with the Bernoulli theorem to gently attract and hold in smoothly distended condition the leading edge portion of a signature being folded, as will appear more fully hereinafter.

The exterior of each vessel end wall 38 may be provided concentrically with a mounting collar, as at 70, for receiving a supporting shaft 71 secured in the collar as by a set screw 72. Thus, with the shaft 71 suitably supported, the vessel 36 may be angularly adjusted to a selected position by loosening and tightening the set screws 72. If desired, suitable adjustment may be provided for the flow of air stream 65, as by varying the tangential opening of the supply nozzle 50, or otherwise.

The assembly 35 may be supported in suitable position by mounting means 75, such as a pair of hangers 76 depending from suitable supports (not shown) and receiving opposite ends of the shaft 71. The shaft 71 may be horizontally or laterally adjustable toward and away from the jaw roll 11, as by a threaded adjustment member 72 extending through a flange 73 on the hanger 76. Obvisously, other means may be provided for adjusting and varying the position and orientation of the assembly 35.

Further to the method of the instant invention, just after the condition of FIG. 6, the gripped sheet portion 34 moves along the circular peripheral path of jaw roll 11, clockwise as shown therein and the leading edge portion 23 of the sheet 22 is released from the circular, counterclockwise peripheral path of tucker roll 10. Thus, the leading edge portion 23 of the sheet 22 is on the exit or downstream side of the nip between jaw and tucker rolls 11 and 10, and free of the rolls.

In this space between the rolls 10 and 11 on the outlet side of the roll nip, the device 35 passes the fluid or air stream 65 generally along and counter to the direction of peripheral movement of jaw roll 11, thence away from roll 11 and toward roll 10, and thence generally along and in the direction of peripheral movement of the roll 10. In the specific illustrated embodiment the air stream or current 65 is arcuate or circular and generally tangent to rolls 10 and 11.

As the air stream 65 is of relatively high velocity, compared to the ambient air, the pressure in the air stream is relatively low compared to the ambient air, as by the Bernoulli theorem. Also, as the leading sheet edge portion 23 after passage through the nip of rolls 10 and 11 moves away from the latter roll, the sheet folding action about the gripped intermediate portion 34 has been started in the condition of FIG. 6. Upon release of the leading edge sheet portion 23 from the tucker roll 10, the leading edge sheet portion is free to seek the relatively low pressure region of the fluid current or air stream 65, as seen in FIG. 7. Also shown therein, the air stream maintains the leading sheet edge portion smoothly distended in the arcuate configuration of the air stream, to avoid or prevent corrugations, wrinkles, creases or the like. It is believed that the high velocity of the air stream, and therefore its low pressure, is slightly spaced from the outer face or surface of the nether cylindrical side wall 37, as by surface friction laminar flow, so that the leading sheet edge portion 23 is effectively prevented from damaging contact with the cylinder surface.

Continued clockwise movement of jaw roll 11 from the position of FIG. 7 to that of FIG. 8 causes the arcuately configured, previously leading sheet edge portion 23 to gradually engage with or roll upon the trailing sheet edge portion 24, as seen in FIG. 8. That is, the sheet edge portion 23 is pulled in a gentle arc by the jaw cylinder 11 away from the tucker cylinder 10 until the leading edge portion 23 gently "marries" the trailing edge portion 24, without the forceful engagement or violent slap heretofore occuring at higher machine speeds.

The cylindrical shape of the vessel 36, and particularly of the upper surface or face of the side wall 37 provides advantages in addition to the above described smooth folding operation of the leading edge portion back upon the trailing edge portion.

The upper face of the cylinder 37, as between the air stream supply nozzle 50 and return 60 may be somewhat less than semicylindrical, say about 165 degrees. The cylindrical configuration permits of quick, easy and accurate adjustment angularly about the cylinder axis in the mounting hangers 75, as described hereinbefore. Also, the cylindrical configuration of the vessel 36 permits of the internal, semicylindrical chambers 40 and 41 defining supply and return plenums as an integral part of the assembly for economy in manufacture and operating costs. The device 35 also affords convenient removal of paper dust by the simple expedient of providing filtering in the air handling system between and associated with the air outlets 46 and inlets 45. Such air cleaning procedure insures long, trouble free operating life to the overall equipment, and the filter means may be disposable and replaceable without press down time. Further by the instant method and apparatus the release timing operation of the sheet holding members or pins 20 and 21 is less critical, permitting of greater flexibility in cam operation and greatly enhancing the intervals between maintenance.

From the foregoing it is seen that the present invention provides a signature folding apparatus and method which are extremely simple in structure and implementation, permit of higher press operating speeds to effect unit cost reduction, and which otherwise fully accomplish their intended objects.

Although the present invention has been described in some detail by way of illustration and example for purposes of clarity of understanding, it is understood that certain changes and modifications may be made within the spirit of the invention.

What is claimed is:

1. In a sheet folding machine including rotary tangential tucker and jaw rolls for respective edgewise feeding of a sheet to the nip of said rolls and there gripping a bent portion of said sheet intermediate its leading and trailing edges, the improvement comprising a working surface on the downstream side of and facing toward said nip, and air stream producing means associated with said working surface for passing an air stream along said working surface in the direction away from said jaw roll, to maintain the leading sheet edge portion smoothly extended during folding back on the trailing edge sheet portion.

2. A sheet folding machine according to claim 1, said working surface being smooth to facilitate air stream flow.

3. A sheet folding machine according to claim 1, said working surface being convexly arcuate to effect convex curvature of said leading edge portion toward said trailing edge portion, for gradual engagement thereof.

4. A sheet folding machine according to claim 3, said working surface being convexly cylindrical and having spaced regions in facing spaced relation with respective rolls.

5. A sheet folding machine according to claim 1, said air stream producing means comprising an air outlet adjacent to said jaw roll, and an air inlet adjacent to said tucker roll.

6. A sheet folding machine according to claim 5, said working surface being convexly arcuate between said air outlet and inlet.

7. A sheet folding machine according to claim 6, said working surface being convexly cylindrical and having spaced regions thereof in facing spaced relation with respective rolls.

8. A sheet folding machine according to claim 1, in combination with a hollow cylinder on the downstream side of said nip generally parallel to said rolls and defining said working surface, said hollow cylinder having a pair of internal air chambers communicating with said air stream producing means.

9. A sheet folding machine according to claim 8, said air stream producing means comprising an air outlet on said hollow cylinder adjacent to said jaw roll and communicating with one of said internal air chambers, an air inlet on said cylinder adjacent to said tucker roll and communicating with the other of said internal air chambers.

10. A method of folding a sheet comprising: feeding a sheet edgewise along a first path, gripping an intermediate portion of the sheet, moving the sheet by the gripped portion along a second path away from said first path with the leading and trailing edges of the sheet free, and directing a fluid stream counter to and away from said second path to extend and guide the leading edge portion of the sheet back against the trailing edge sheet portion.

11. The method according to claim 10, further characterized wherein said first and second paths are generally circular and tangent.

12. The method according to claim 10, further characterized wherein said air stream is arcuate and generally tangent to said second path.

13. A sheet folding machine comprising a rotary jaw roll, a rotary tucker roll tangent to said jaw roll for edgewise feeding of a sheet to the nip of said jaw and tucker rolls for gripping by the jaw roll of a bent intermedaite sheet portion, and an air current on the outlet side of said nip moving away from said jaw roll and toward said tucker roll, to maintain the leading edge portion of said sheet smoothly extended during folding back on the trailing edge sheet portion.

14. A sheet folding machine according to claim 13, said air current extending counter to the surface movement of said jaw roll and along the surface movement of said tucker roll.

15. A sheet folding machine according to claim 14, said air current extending along an arcuate path generally tangent to said jaw and tucker rolls.

16. A method of sheet folding comprising moving a sheet edgewise along an arcuate first path, gripping an intermediate sheet portion, moving said gripped sheet portion along an arcuate second path tangent to said first path at the location of gripping, passing a fluid current along and counter to the direction of said second path at a location beyond the tangent region of said first and second paths, then passing the fluid current toward said first path, and then passing the fluid current along and in the direction of said first path, for maintaining the leading edge portion of the sheet smoothly extended during folding back on the trailing sheet edge portion.

17. A method of sheet folding according to claim 16, further characterized in passing said fluid current along an arcuate path generally tangent to said first and second paths.

* * * * *